US005816434A

United States Patent [19]

Weinstein

[11] Patent Number: 5,816,434

[45] Date of Patent: Oct. 6, 1998

[54] DEVICE FOR FOLDING UP BED SHEETS AND THE LIKE

[76] Inventor: Alan Gil Weinstein, 917 Brookwood Rd., Jacksonville, Fla. 32207

[21] Appl. No.: 512,031

[22] Filed: Aug. 7, 1995

[51] Int. Cl.[6] ..... A41H 33/00; B41L 43/04

[52] U.S. Cl. ..... 223/37; 223/1; 270/41

[58] Field of Search ..... 223/37, 38, 1; 493/405; 270/41

[56] References Cited

U.S. PATENT DOCUMENTS

| | | | |
|---|---|---|---|
| 2,863,591 | 12/1958 | Butler | 223/37 |
| 2,905,367 | 9/1959 | Coutu | 223/37 |
| 3,161,333 | 12/1964 | Lew | 223/37 |
| 3,236,425 | 2/1966 | Sipe | 223/37 |
| 3,385,484 | 5/1968 | Therkildsen | 223/37 |
| 3,510,031 | 5/1970 | Robinson | 223/37 |
| 3,538,555 | 11/1970 | Langston | 24/81 |
| 3,689,059 | 9/1972 | Gross | 269/100 |
| 3,713,643 | 1/1973 | Gerstenberger | 270/61 |
| 3,884,459 | 5/1975 | Gunn et al. | 270/61 |
| 3,970,226 | 7/1976 | Lanagan et al. | 223/37 |
| 3,984,036 | 10/1976 | Fritschi | 223/37 |
| 3,994,485 | 11/1976 | Weir | 270/61 |
| 4,018,368 | 4/1977 | Haldi | 223/37 |
| 4,932,626 | 6/1990 | Guillot | 248/548 |

*Primary Examiner*—Bibhu Mohanty

[57] ABSTRACT

A sheet folding device that enables a single operator to easily fold bed sheets (fitted and flat), bed spreads, tablecloths and other sheet-like materials, the device employing a sheet clutching clamp 20 and a folding bar 28 both attached to a mounting plate 7. Placement of the mounting plate 7 onto any vertical surface enables the device to accommodate articles of differing sizes. A sheet clutching clamp 20 in my preferred embodiment is a spring clip 20. The folding bar 28 is the element about which a fold is made. In my preferred embodiment a 90 degree hook with an elastomeric sleeve 40 is effective for this task. The present invention can be mounted to a wall, mobile cart or any vertical surface. A sheet may refer to a bed sheet (fitted or flat), bed spread, tablecloth or any other material that requires folding. To fold a sheet, an operator slides a portion of the sheet, such as a corner, into the spring clip 20. Then with simple manual manipulation, employing the spring clip 20 and folding bar 28, the folding operation is completed quickly, efficiently and neatly without risk of the sheet touching a soiled floor.

4 Claims, 6 Drawing Sheets

DEVICE FOR FOLDING UP BED SHEETS AND THE LIKE

BACKGROUND

1. Field of Invention

This invention is in the field of sheet folding devices, specifically a device that enables one person to quickly, efficiently and neatly fold bed sheets and the like.

2. Description of Prior Art

It ordinarily requires two people to fold up bed sheets and the like, if this work is to be done in a neat and time-saving manner. It is cumbersome for a single person to carry out the stretching and pleating required to fold a sheet, especially large and fitted sheets. The problem is common to the home and commercial institutions, such as laundry cleaning companies, resorts/inns, hotels/motels, hospitals, dormitories, restaurants, and coin-operated laundry facilities.

The present invention relates to a device for assisting a single operator in the complete folding up of bed sheets, bed spreads and other sheet-like materials, such as fitted sheets and tablecloths. My invention enables a single operator to carry out the work with little effort and without the help of another person.

Several proposals have been made heretofore to provide help to a single person trying to overcome the task, however these are subject to deficiencies and disadvantages that are avoided by the present invention. One apparatus for folding sheets is disclosed in U.S. Pat. No. 3,970,226 issued to John B. Lanagan and Stephen H. Tilsen (1976). Although the apparatus may be effective, it is nevertheless a four legged floor table and is by far too large to accommodate the average home laundry room. Available space is certainly a consideration and should always be maximized whenever possible. This applies to private homes and commercial institutions. My invention is not a floor type unit, but rather a compact wall mounted device that requires only a small amount of wall space and no valuable floor space.

Another apparatus for folding sheets is disclosed in U.S. Pat. No. 3,994,485 issued to Henry John Weir (1975). In addition to this folding mechanism being another floor unit type device, it also requires an electrical power source. Any electrical appliance contains complex circuitry. This implies that maintenance and repair is dependent upon and must be performed by a professional electrician. A unit in disrepair can create delays and be costly. My sheet folding device is not electrical in nature and therefore does not require an electrical power source. Rather, it is a simple and durable mechanical device that, if need be, could easily be installed, removed, repaired or replaced by any novice operator. This benefit decreases the cost of maintenance and increases the ease of operation.

All of the sheet folding devices heretofore known suffer from a number of disadvantages:

a) Their design renders them unnecessarily bulky and large, thereby occupying limited and valuable space.

b) Their design requires that they be stationed on the floor only.

c) They provide the operator with only one or two possible folding sequences.

d) They must be adjusted or modified to accommodate articles of differing sizes and shapes.

e) Their designs incorporate moving parts, relatively heavy components as well as electrical circuitry in some cases. This suggests that an increased number of parts can lead to an increased potential for disrepair.

OBJECTS AND ADVANTAGES

Accordingly, it is a principal object and advantage of this invention to provide a device that enables a single operator to quickly, efficiently and neatly fold any size sheet with little effort and without help from another person.

Several other principal objects and advantages of this invention are to provide a device for folding up bed sheets and the like:

a) that is readily and simply installed by the novice in the home or in any commercial establishment and takes up very little space b) that may be mounted to a wall, mobile cart or any vertical surface c) that assists the single operator in folding a sheet in the sequence most desired, as described above, as well as allowing the operator to fold a sheet in any number of desired sequences d) that accommodates articles of differing sizes, such as bed sheets (fitted and flat), bed spreads, and tablecloths, without the operator having to make any adjustments to the device e) that is relatively light weight and simple, yet very durable and effective.

Further objects and advantages are to provide a sheet folding device that prevents sheets from touching a soiled floor, that is safe and simple to employ and does not require any special skill to operate, that is inexpensive to manufacture and that my be made in any desired color. Still further objects and advantages of the present invention will become apparent from a consideration of the drawings and ensuing description.

BRIEF DESCRIPTION OF THE DRAWINGS

A clearer understanding of my invention and its operations will become apparent from the following detailed description and related drawings.

ELEMENTS AND DETAILS

Figure 1:
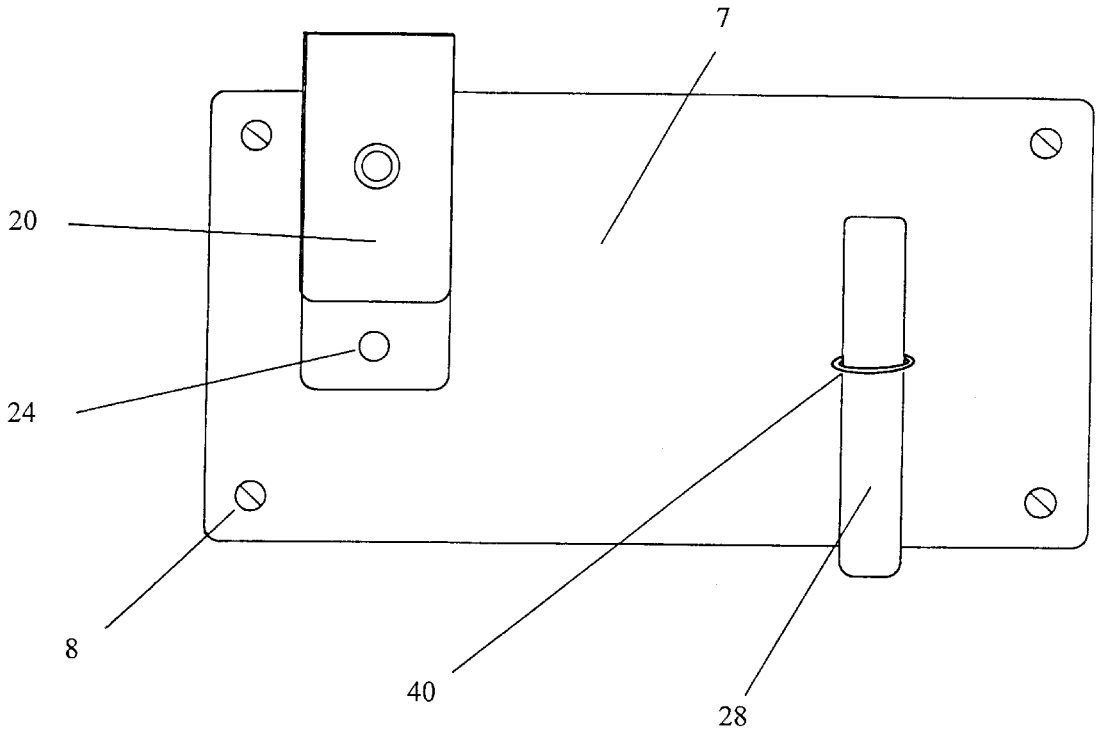
FIG. 1 is a frontal view of my invention.

7. Mounting plate
8. Mounting screw
12. Mounting screw hole
16. Elastomeric ring
20. Spring clip
24. Semi-tubular rivet
28. Folding bar
32. Folding bar upset
36. Nut
38. Hole
40. Elastomeric sleeve
44. Elastomeric coating

48. Rough surface texture
52. Protrusion
56. Inward slope

SUMMARY

My invention provides a highly reliable and quality product that enables one person to easily, quickly, efficiently and neatly fold any size bed sheet, bed spread, tablecloth or other material that requires folding. My device for folding up be sheets and the like employs a sheets clutching clamp and a folding bar attached to a mounting plate. Proper placement of the mounting plate to any vertical surface enables the device to accommodate articles of differing sizes.

DETAILED DESCRIPTION OF PREFERRED EMBODIMENTS

For purposes of promoting an understanding of the principles of the invention, reference will now be made to the embodiments illustrated in the drawings. It will nevertheless be understood that no limitations of the scope of the invention is thereby intended, such alterations and further modifications in the illustrated device, and such further applications of the principles of the invention as illustrated therein being contemplated as would normally occur to one skilled in the art to which the invention relates.

FIG. 1 illustrates a frontal view of the present invention. A spring clip 20 is attached to a mounting plate 7 by two semi-tubular rivets 24. The number of semi-tubular rivets 24 required to attach spring clip 20 to mounting plate 7 may vary depending upon the nature of spring clip 20. A typical embodiment of the present invention, as shown in FIG. 1, requires two semi-tubular rivets 24 for this task.

Figure 2:
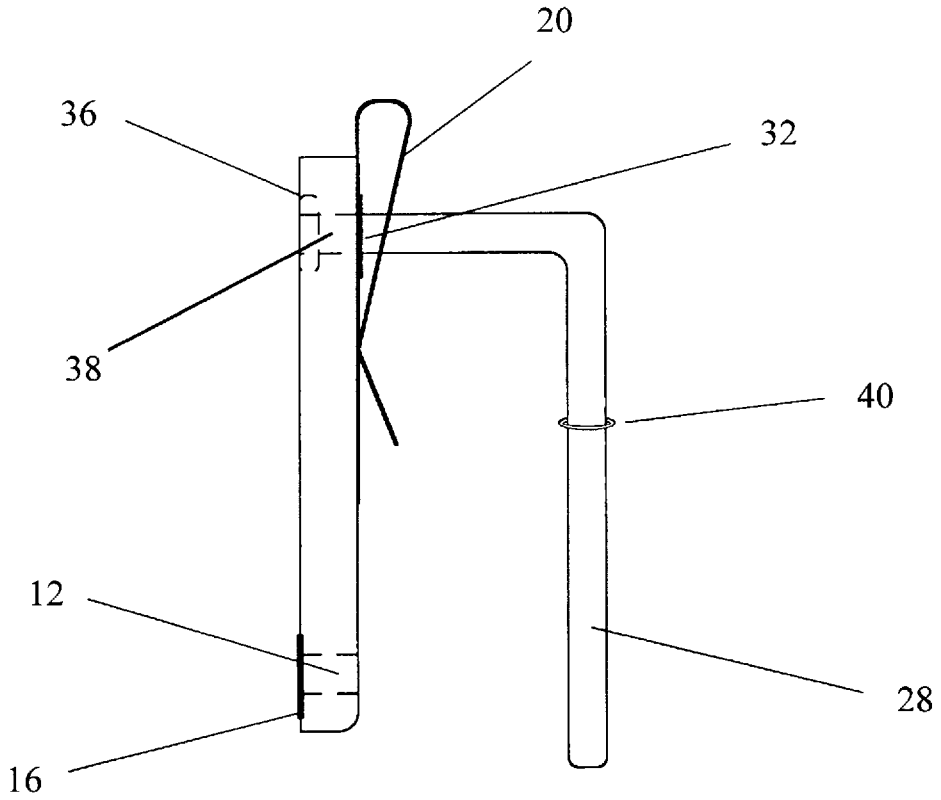
FIG. 2 is a profile view of my invention illustrating a folding bar with an elastomeric sleeve.

FIG. 2 illustrates a profile view of the present invention. A folding bar 28 is shown attached to mounting plate 7. The upper end portion of folding bar 28 is threaded. A folding bar heading or upset 32 is located at the upper portion of folding bar 28, adjacent to the threaded end. Folding bar upset 32 may or may not be manufactured as part of folding bar 28. Folding bar 28 fits into a hole 38 in mounting plate 7. The diameter of folding bar upset 32 is greater than that of hole 38, thereby ensuring that folding bar 28 go in only a prescribed distance. Folding bar 28, being properly seated, is then secured to mounting plate 7 by a nut 36. Hole 38 is countersunk on the back side, enabling nut 36 to nest within mounting plate.

In the preferred embodiment, mounting plate 7 is made of a rigid and stable plastic, such as polycarbonate. However, mounting plate 7 can also be constructed of other suitable materials that can support spring clip 20 and folding bar 28. These materials can include, but are not limited to acrylic, polypropylene, nylon, other suitable plastics, stainless steel, aluminum, basic steel and wood.

An elastomeric ring 16 may be placed between mounting plate 7 and the vertical surface onto which it is secured. Mounting plate 7 may be secured to a vertical surface by a mounting screw 8, as shown in FIG. 1. Mounting screw 8 passes through a mounting screw hole 12 to secure mounting plate 7 to a vertical surface (FIGS. 1 and 2). There are up to four mounting screw holes 12 in mounting plate 7 to accommodate up to four mounting screws 8. Securing mounting plate 7 to a vertical surface can include, but is not limited to screws, anchors and/or two sided adhesive.

Figure 3:
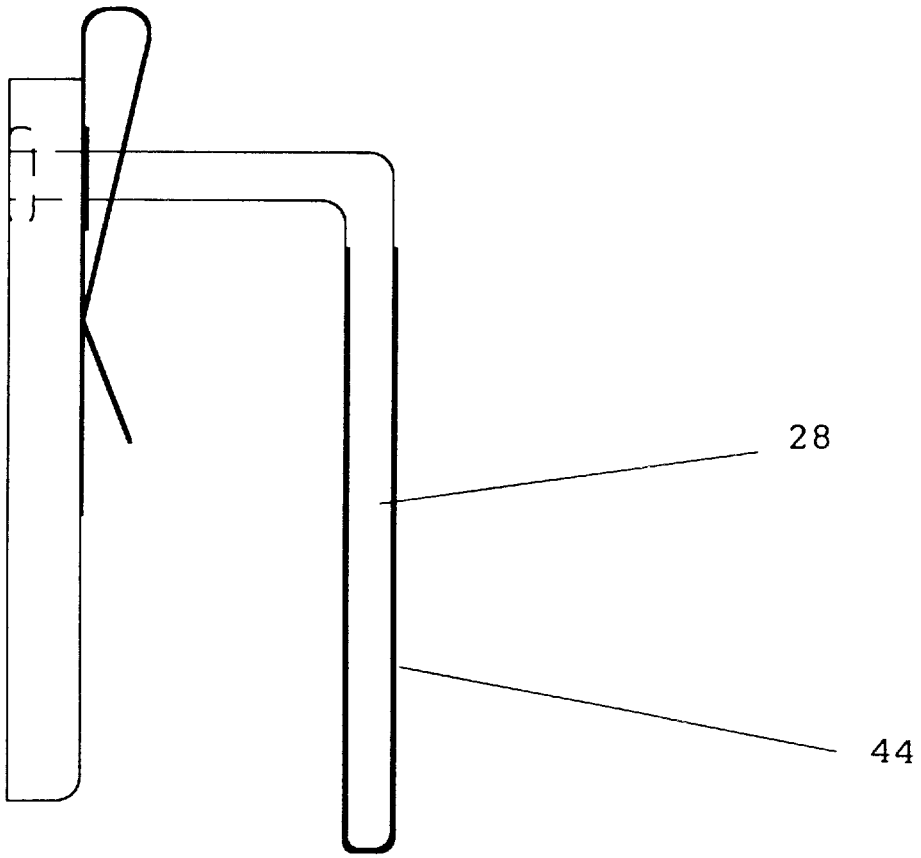
FIG. 3 is a profile view of my invention illustrating a folding bar with an elastomeric coating.
Figure 4:
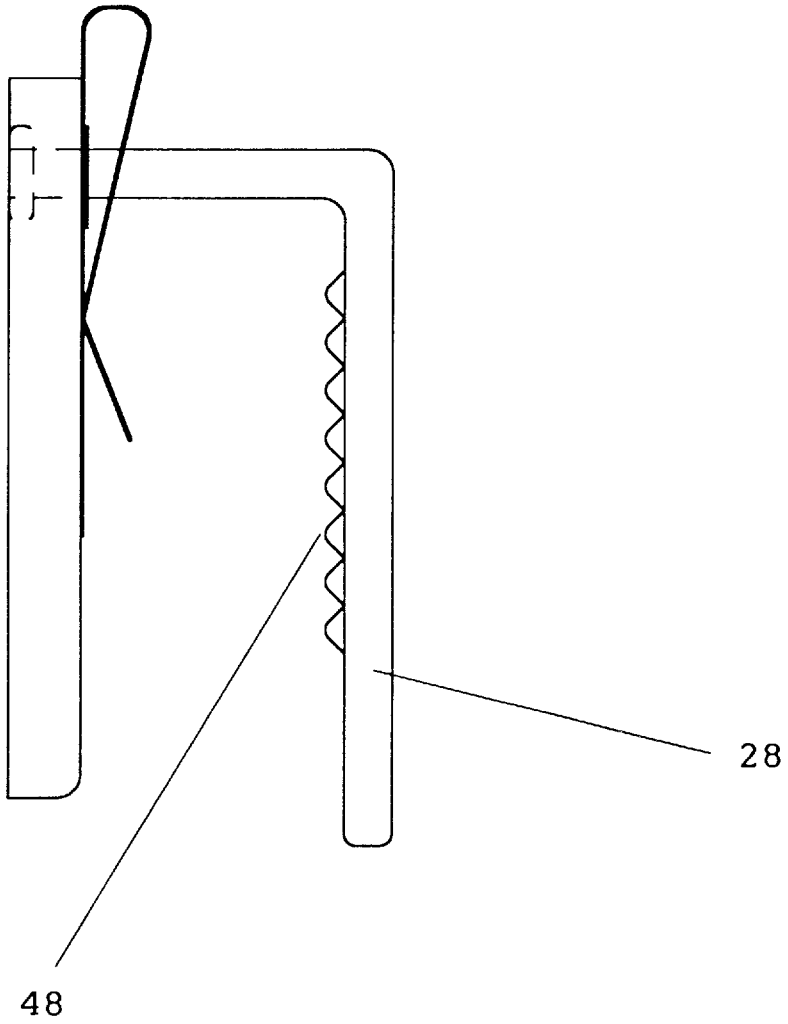
FIG. 4 is a profile view of my invention illustrating a folding bar having a rough surface texture.
Figure 5:
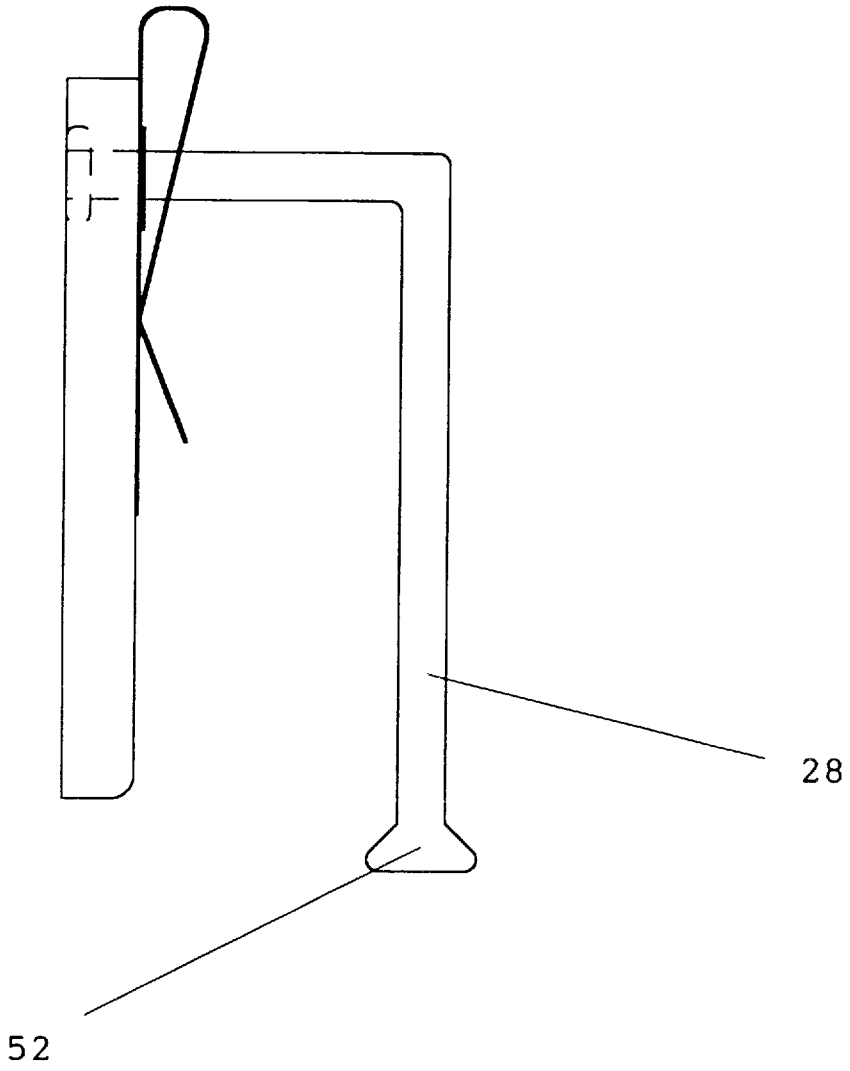
FIG. 5 is a profile view of my invention illustrating a folding bar having a protrusion.
Figure 6:
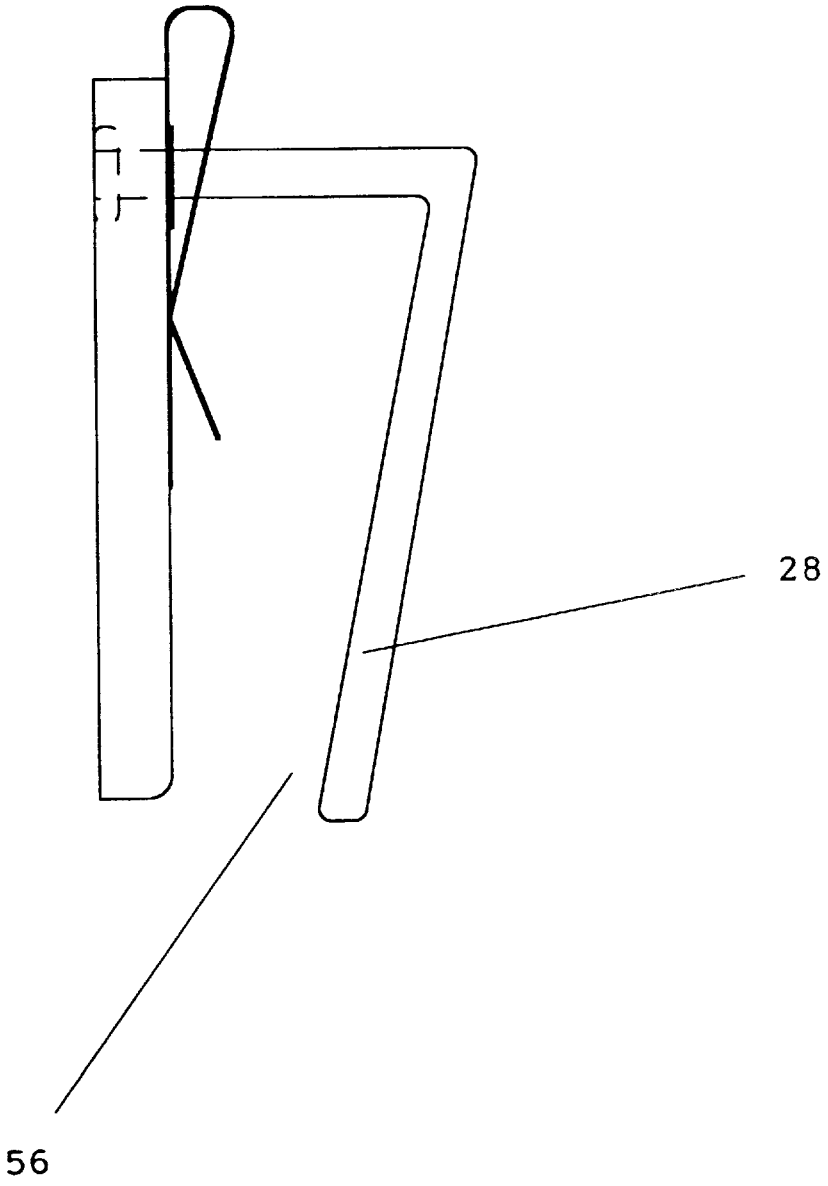
FIG. 6 is a profile view of my invention illustrating a folding bar having an inward slope.

There are various possibilities with regard to the relative shape of folding bar 28. There are a number to ways to design folding bar 28 to catch a sheet and keep the sheet from dropping off. FIGS. 1 and 2 illustrates folding bar 28 with an elastomeric sleeve 40. FIG. 3 shows folding bar 28 with an elastomeric coating 44. FIG. 4 shows folding bar 28 having a rough surface texture 48. Rough surface texture 48 may or may not be manufactured as part of folding bar 28. FIG. 5 shows folding bar 28 having a protrusion 52. Protrusion 52 may or may not be manufactured as part of folding bar 28. FIG. 6 snows folding bar 28 having an inward slope 56. Inward slope 56 may or may not be manufactured as part of folding bar 28.

OPERATION OF THE INVENTION

The normal and most desired sequence for folding a bed sheet is to fold the sheet in half, then in quarters, then in eighths, then in sixteenths (if desired), and finally once or twice transversely. This results in a folded sheet which can be unfolded and spread most easily when preparing beds. The present invention provides a folding device that allows a single operator to fold a sheet in the desired sequence, as described above. In this disclosure the term "sheet" can be a bed sheet (fitted or flat), bed spread, tablecloth or any other material that requires folding.

As shown in FIG. 1 the sheet folding device employs a sheet clutching clamp 20 and a folding bar 28 both attached to a mounting plate 7. Placement of mounting plate 7 onto any vertical surface enables the device to accommodate articles of differing sizes. It would be obvious to one skilled in the art to design any number of workable sheet clutching clamps 20, but in my preferred embodiment it is a spring clip 20 (FIGS. 1, 2, 3, 4, 5, and 6).

Folding bar 28 is the element about which a fold is made. It would also be obvious to one skilled in the art to design any number of folding bar shapes that can catch a sheet. However, in my preferred embodiment, a 90 degree hook with an elastomeric sleeve 40, such as a standard rubber grommet, is effective for this task (FIG. 2). Folding bar 28 catches the sheet and elastomeric sleeve 40 keeps the sheet in place to prevent it from dropping off. FIG. 3 shows a folding bar 28 with an elastomeric coating 44. In this illustration elastomeric sleeve 40 is replaced by an elastomeric coating 44. The operation is the same in that folding bar 28 catches the sheet and elastomeric coating 44 keeps the sheet in place to prevent it from dropping off. FIG. 4 illustrates a folding bar 28 that has a rough surface texture 48. In this case, folding bar 28 catches the sheet and rough surface texture 48, which may or may not be manufactured as part of folding bar 28, keeps the sheet in place and prevents it from dropping off. FIG. 5 illustrates a folding bar 28 that has at least one protrusion 52. Folding bar 28 catches the sheet and protrusion 56, which may or may not be manufactured as part of folding bar 28, keeps the sheet in place and prevents it from dropping off. FIG. 6 shows a folding bar 28 which has an inward slope 56. Folding bar 28 catches the sheet and inward slope 56, which may or may not be manufactured as part of folding bar 28, keeps the sheet in place and prevents it from dropping off.

The sheet folding device may be mounted to a wall, mobile cart or any vertical surface. To fold a sheet, an operator simply slides one portion of a sheet, such as a corner, upward into the spring clip 20. Holding the other top corner of the sheet in one hand, he/she stands away from the mounting bracket 7 so the sheet is stretched to length. With the other hand, he/she grasps the midpoint of the top edge and makes a fold, bringing the two corners together. The sheet is removed from the spring clip 20 by pulling downward. The operator at this time is holding two corners of the sheet in one hand and the folded corner of that sheet in the other hand. The folding bar 28 can now be used to catch the top center edge of the partially folded sheet, allowing the operator to create another fold. This step may be repeated if an additional fold is desired. Finally, the operator can simply make one or two transverse folds to complete the sequence.

An operator can also begin the sequence by folding one edge of the sheet in half and then sliding either end portion into the spring clip 20. Holding the other end portion of the once folded sheet, he/she can continue on with the folding sequence as described above.

CONCLUSIONS, RAMIFICATIONS, AND SCOPE OF INVENTION

Thus the reader will see that the present invention provides a highly reliable and quality product that enables one operator to easily, quickly, efficiently and neatly fold any size bed sheet, bed spread, tablecloth or other material that requires folding, the product greatly benefiting private homes and commercial institutions. In addition, it is readily and simply installed, may be mounted to any vertical surface, prevents sheets from touching the floor, allows for any number of desired folding sequences and accommodates articles of differing sizes. Furthermore, my invention has additional advantages in that it is safe and simple to employ, does not require any special skill to operate, is inexpensive to manufacture, and may be made in any desired color.

While my above description contains many specificities, these should not be construed as limitations on the scope of the invention, but rather as an exemplification of one preferred embodiment thereof. Many other variations are possible. For example, it would be obvious to one skilled in the art to design any number of workable sheet clutching clamps, but in my preferred embodiment it is a spring clip. I place the spring clip on the left side of the device to facilitate the technique of the folding sequence. I also raise the spring clip appropriately so the operator can easily locate it. The spring clip could be placed on any part of the mounting plate with any possible relation to the folding bar. It would also be obvious to one skilled in the art to design any number of folding bar shapes that can catch a sheet. However, in my preferred embodiment a 90 degree hook with an elastomeric sleeve, such as a standard rubber grommet is effective for this task. Mounting the sheet folding device to a vertical surface can also be done in any number of ways including, but not limited to screws, anchors and/or two sided adhesive. Any other element of the present invention and its respective location, shape or design, that could be modified or rearranged to allow the invention to operate in a similar manner, may be possible. The folding technique, as described above, may also be modified by the operator to accommodate individual style.

The present invention may be manufactured and assembled in a number ways. For example, the spring clip, folding bar and mounting bracket may be injection molded together as one unit. Elements of my invention may be milled, stamped, molded or manufactured as any working combination of the above. In addition, the manner in which any element is attached to another may also vary. For example, the spring clip and folding bar could be attached to the mounting plate by using snap-in and fitted type parts.

Furthermore, the present invention can be made of injection molded or milled plastic, stainless steel, aluminum or any other suitable material. In my development of the invention I have observed that parts made of aluminum will smudge onto the the cloth and stain the material. A suitable solution has been found to be an anodized coating on the aluminum. The aluminum can also be covered with a vinyl-powder coating. Ordinary enamel paint can also be used, but it tends to chip. I have also observed that parts made of stainless steel or plastic exhibit lasting durability and will not rust, consequently staining the material. A spring clip made of stainless steel or plastic will also retain superior spring memory.

Accordingly, the scope of the invention should be determined not by the embodiments illustrated, but by the appended claims and their legal equivalents.

I claim:

1. A device to aid a single operator to fold bed sheets and table cloths without risk of said sheets or said cloths touching the floor, comprising:

a mounting plate attachable to a vertical surface, fixed to said mounting plate, a one-part spring clip accessible at its lower end made from a bent member and bent for clutching a portion of said sheet or said cloth by merely sliding said portion under said lower end, horizontally spaced from said spring clip, a non-movable and non-clamping generally L-shaped folding bar extending first out generally horizontally and then generally downward vertically attached to said mounting plate, a portion of said folding bar accessible on its lower end for catching said sheet or said cloth for folding, a portion of said folding bar including slip resisting means on the lower end to keep said sheet or said cloth from dropping off.

2. A device as set forth in claim 1 wherein said slip resisting means is an elastomeric ring.

3. A device as set forth in claim 1 wherein said slip resisting means is a protrusion on said folding bar.

4. A device as set forth in claim 1 wherein said folding bar has an inward slope to resist said sheet or said cloth from dropping off.

* * * * *